US005606814A

United States Patent [19]

Szywalla et al.

[11] Patent Number: 5,606,814

[45] Date of Patent: Mar. 4, 1997

[54] FILM WINDING MECHANISM AND DISPLAY APPARATUS

[75] Inventors: Henry Szywalla, London; James Melville, Hertfordshire, both of Great Britain

[73] Assignee: Adverite PLC, Wolverhampton, England

[21] Appl. No.: 505,197

[22] PCT Filed: Feb. 24, 1994

[86] PCT No.: PCT/GB94/00366

§ 371 Date: Aug. 14, 1995

§ 102(e) Date: Aug. 14, 1995

[87] PCT Pub. No.: WO94/20946

PCT Pub. Date: Sep. 15, 1994

[30] Foreign Application Priority Data

Mar. 1, 1993 [GB] United Kingdom ..... 9304099

[51] Int. Cl.[6] ..... G09F 11/29

[52] U.S. Cl. ..... 40/471; 40/518

[58] Field of Search ..... 40/471, 483, 518

[56] References Cited

U.S. PATENT DOCUMENTS

| | | | |
|---|---|---|---|
| 718,763 | 1/1903 | Hoermle | 40/471 X |
| 1,016,944 | 2/1912 | Kent | 40/471 |
| 4,205,801 | 6/1980 | Decaux | 40/471 |

FOREIGN PATENT DOCUMENTS

| | | |
|---|---|---|
| 393201 | 12/1908 | France . |
| 2644921 | 9/1990 | France . |
| 2659161 | 9/1991 | France . |
| 252621 | 10/1912 | Germany . |

*Primary Examiner*—Kenneth J. Dorner
*Assistant Examiner*—Cassandra Davis
*Attorney, Agent, or Firm*—Nixon & Vanderhye P.C.

[57] ABSTRACT

A poster display apparatus winds a film carrying the posters between spools. The surface speeds of rotation of the spools are equalized by a rising and falling weight carried by a cord interconnecting pulleys carried by the spool axles.

6 Claims, 3 Drawing Sheets

FILM WINDING MECHANISM AND DISPLAY APPARATUS

DESCRIPTION

This invention relates to an improved drive mechanism for winding a flexible film or sheet, hereinafter called a film, between spools. The mechanism is primarily intended for incorporation into an apparatus wherein the film carries a series of advertising posters which are successively displayed as the film is wound from one spool to another. It is an objective of the invention to provide an improved display apparatus of this type.

The most convenient means of driving a spool to rotate is through an axle carrying the spool. In poster changing devices this drive means presents a problem in that the surface speed of a spool for a given axle speed varies as the effective diameter of the spool increases whilst film is being wound on to it and vice versa. This variation in surface speeds may give rise to tightening and slackening of a film being wound between spools and speeds to be eliminated.

The present invention proposes to deal with this problem by providing a film moving mechanism for a poster display apparatus such mechanism comprising first and second spools between which a carrier film is wound, means for driving an axle carrying the first spool and an active linear connection between spool axles, said connection acting to control and vary the axle speeds so as to maintain the surface speeds of the spools substantially equal.

More specifically in accordance with the present invention there is provided a mechanism for winding a film between first and second spools which comprises a motor drive to an axle carrying the first spool, a drive cord or equivalent extending between pulleys or equivalents on respective axles of the first and second spools said cord carrying a weight which rises and falls as the effective length of the cord between pulleys varies to adjust the speed of the axle of the second spool to maintain the equality of surface speeds.

The invention will now be described as embodied in a display apparatus shown in the accompanying drawings wherein.

Figure 2:
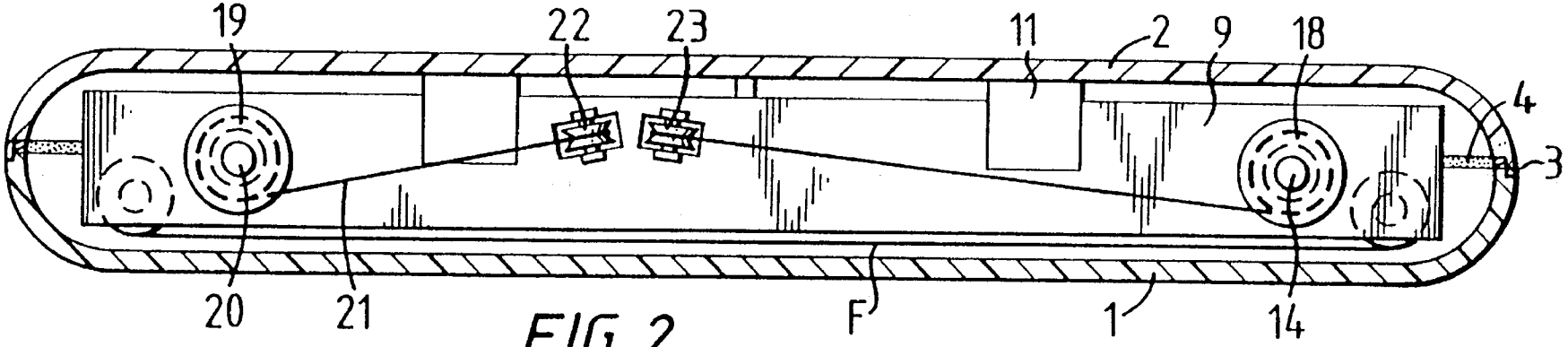
FIG. 2 is a section on the line II—II of FIG. 1.
Figure 3:
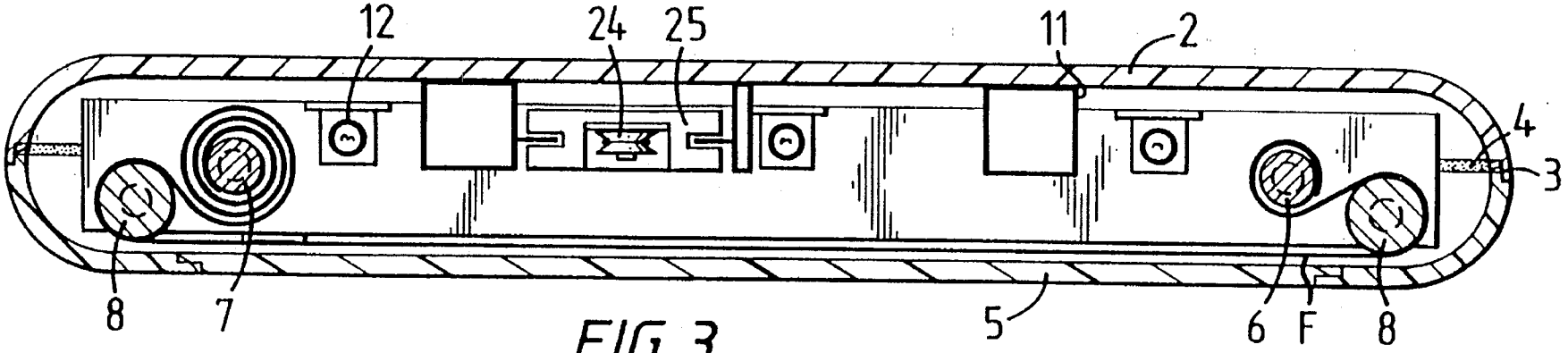
FIG. 3 is a section on the line III—II of FIG. 1.

The apparatus described and illustrated is intended for positioning in a public location such as a shopping precinct and is supported in its display position by means not shown, for example a pillar. The apparatus essentially comprises an upstanding and robust casing, rectangular with rounded corners and made of front and rear similar parts 1 and 2 fitting together as shown in FIGS. 2 and 3 with a rebate 3 and gasket 4 so as to provide a sealed and protected interior for the working parts. The casing parts are made of suitably strong material such as steel or reinforced plastics so that the interior and working parts are protected from the elements and damage. A viewing window 5 is provided at the front this being formed of suitable tough transparent material.

Figure 4:
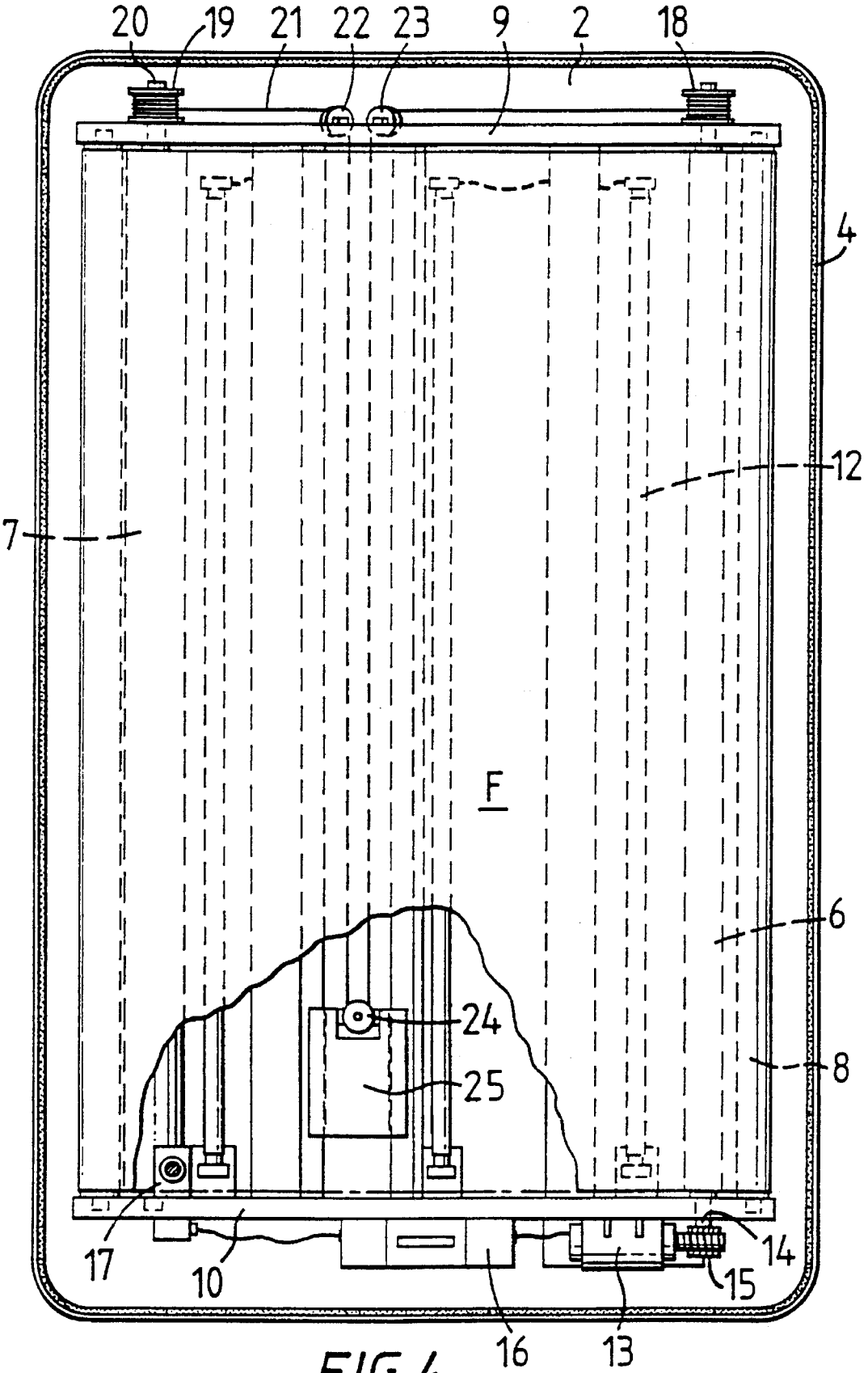
FIG. 4 is a front view of the apparatus with the front of the casing removed and the film partly removed to show working parts.

The poster changing and display mechanism seen in FIGS. 2 to 4 is positioned within the casing and comprises a carrier film F of translucent plastics, for example a polyester, wound between a first spool 6 and a second spool 7 over idler rollers 8 to provide a frontal working reach moving horizontally behind window 5 successively to display posters P (FIG. 1) to a viewer. In this specification the word 'spool' is used functionally being a simple roller around which the film is wound. The four rollers are mounted to rotate between upper and lower cross members 9 and 10 fixed together by square section uprights 11. Vertically disposed fluorescent lamp tubes 12 or other suitable means are mounted between the uprights to provide back lighting and to illuminate the film F and the posters P carried thereby.

An electric motor 13 to drive axle 14 of spool 6 through gears is supported beneath lower cross member 10 as is a control device schematically indicated at 16. The motor 13 incorporates a brake under the control of device 16. An optical sensor 17 is also carried by cross member 16 to be adjacent to the film F.

The upward extension of axle 15 above cross member 9 carries a rotational member, e.g., a pulley drum 18. A similar member, e.g., drum 19 is carried on an upward extension of axle 20 carrying follower spool 7. A flexible elongated element, e.g., a cord 21 extends between drums 18 and 19 over pulleys 22 and 23 and around pulley 24 of weight 25. Weight 25 is mounted for vertical movement only on guide tracks 26. In the particular embodiment being described the weight is 18 kg and the electric motor is rotated at 100 watts. It will be noted from FIGS. 2 and 3 that the film F and the cord 21 are so wound that when the film is wound on to the right hand spool 6 the cord is wound off its pulley drum 18 and when the film is wound off left hand spool 7 the cord is wound on pulley drum 19.

The pulleys have sufficient cord wound on them to allow for the vertical movements of the weight to be described. The geometry of the particular device being described has the weight 25 non-centrally disposed and to accommodate this and to allow the pulley to move in a vertical track without horizontal movement the pulleys 22 and 23 are inclined as shown.

Figure 1:
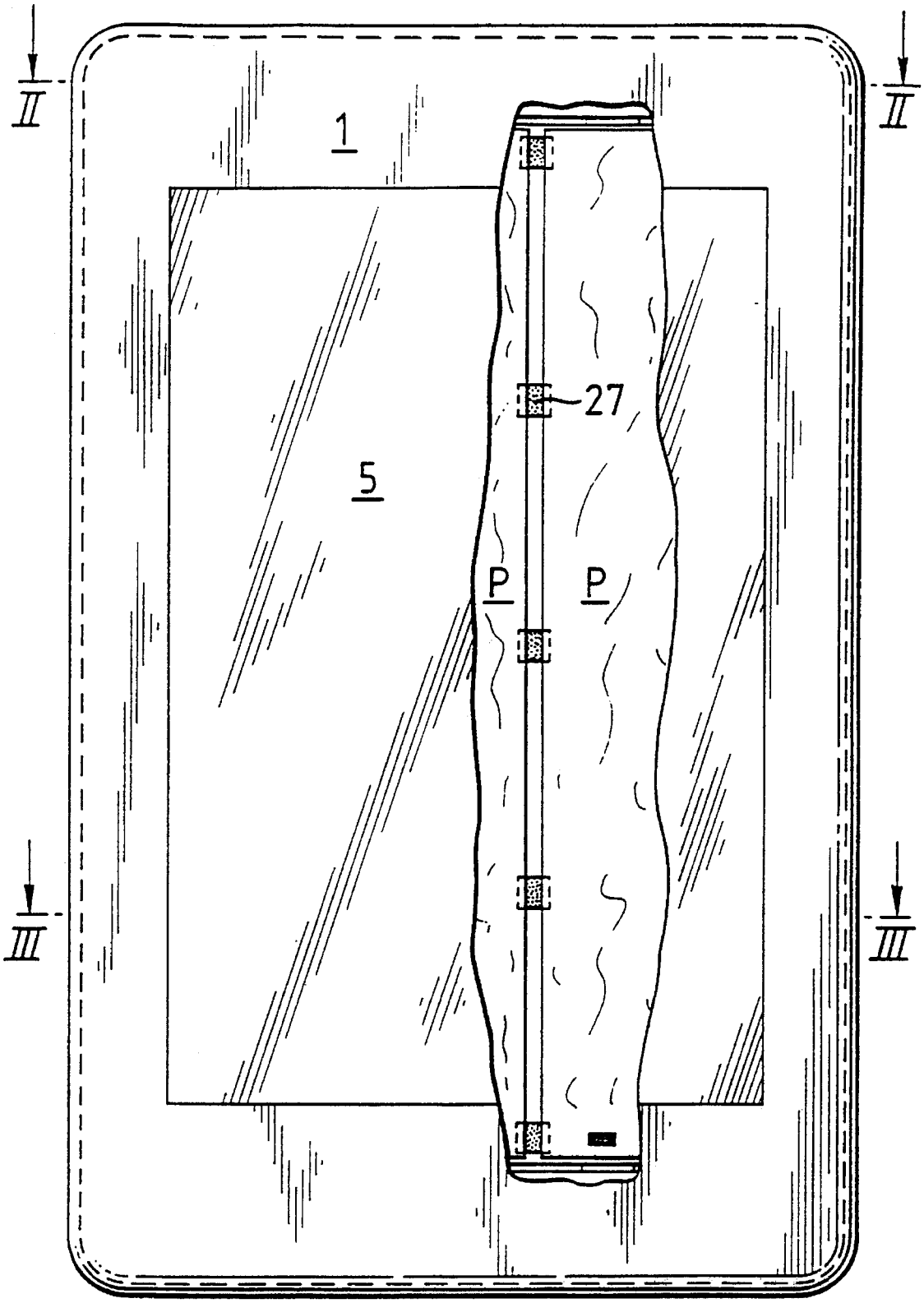
FIG. 1 is a front view of the complete apparatus with the front partly broken away and the carrier film enlarged to show the posters on its carrier film.

Posters P are secured to film F by elastic pieces to allow them to pass over idlers L. This is illustrated in FIG. 1 where spaced adhesive patches 27 are fixed to the film each patch 27 having elastic edge portions adhesively secured to adjacent poster edge portions. FIG. 1, of course, shows an intermediate moving stage. Each poster P is successively halted for a predetermined period in register with window 5.

The operation of the apparatus will now be described with reference to FIGS. 2 to 4. The mechanism is illustrated as just starting to wind film F on to the motor driven spool 6 by rotation of axle 14 in the clockwise sense. Pulley drum 18 is driven by the axle this sense to wind off cord 21. Winding drive is thus transmitted to spool 7 by the film F over idler rollers 8. Drive is also transmitted between pulley drums 18 and 19 via pulleys 22, 23 and 24 carrying weight 25 by cord 21 constituting an active force-applying connection. The cord is wound on to drum 19. At this stage spool 6 has a smaller effective diameter (spool+ film on it) than spool 7 by virtue of the relatively small amount of film wound on to it. The speed of axle 20 necessary to maintain the surface speed spool 7 equal to that of spool 6 is varied initially by raising the weight 25. This mechanism continues to vary the speed of axle 20 to equalise the spool surface speeds. When the effective diameter of the motor driven spool 6 becomes greater than the follower spool 7 then the reverse situation arises and the weight is lowered. When the film is wound on to spool 6 and all the posters have been displayed the motor is reversed and the film wound back from right to left. It will be appreciated that during this reverse winding the drive to spool 7 is provided by the weight 25, unwinding of spool 6 being controlled by the motor though the weight rises and falls as described above to maintain equalised spool surface speeds.

The film movement described above as continuous is in fact intermittent to allow stationary intervals to display the individual posters carried by the film. To achieve this the film carries markers to be sensed by sensor 17 which in turn activates the control device 16 to stop and brake the motor 13 for the elected period to hold a poster still in the window 5 for display. Such detector devices are within the art.

We claim:

1. A film moving mechanism for poster display apparatus, such mechanism comprising:

first and second spools between which a carrier film is wound;

first and second axles, respectively, carrying the spools for rotation at adjustable rotational speeds and the film wound thereon for rotation at respective surface speeds, said first and second axles, respectively, carrying first and second rotational members;

a motor rotationally driving the axle carrying the first spool to rotate the spool;

a flexible elongated element wound around the rotational members and a weight carried by said element intermediate the members, which weight, when the first axle is driven by the motor, rises and falls as the element winds and unwinds around the members to adjust the rotational speeds of the axles, thereby maintaining the surface speeds of the spools substantially equal.

2. A mechanism according to claim 1 wherein the film and the element are so wound that winding the film onto the first spool unwinds the element from said first member onto said second member and unwinding the film from the second spool winds the element onto said second member from said first member.

3. A mechanism according to claim 1 wherein the element between the members on the axles and carrying the weight passes over intermediate members between said first and second members.

4. A display apparatus comprising a casing with a window to allow posters carried by the film to be successively viewed and a mechanism according to claim 1 within the casing.

5. Apparatus as claimed in claim 4 wherein the casing includes front and rear parts sealed and secured to one another.

6. A mechanism according to claim 1 wherein each said rotational member comprises a pulley and said element comprises a cord.

* * * * *